US009097069B2

(12) United States Patent
Håbesland

(10) Patent No.: US 9,097,069 B2
(45) Date of Patent: Aug. 4, 2015

(54) TOOL FOR CENTERING A CASING OR LINER IN A BOREHOLE AND METHOD OF USE

(76) Inventor: Geir Håbesland, Oslo (NO)

( * ) Notice: Subject to any disclaimer, the term of this patent is extended or adjusted under 35 U.S.C. 154(b) by 0 days.

(21) Appl. No.: 14/365,584

(22) PCT Filed: Sep. 13, 2012

(86) PCT No.: PCT/NO2012/050176

§ 371 (c)(1),
(2), (4) Date: Aug. 20, 2014

(87) PCT Pub. No.: WO2013/039406

PCT Pub. Date: Mar. 21, 2013

(65) Prior Publication Data

US 2014/0352979 A1 Dec. 4, 2014

(30) Foreign Application Priority Data

Sep. 13, 2011 (NO) ..... 20111244

(51) Int. Cl.
*E21B 17/08* (2006.01)
*E21B 17/10* (2006.01)
*E21B 23/04* (2006.01)

(52) U.S. Cl.
CPC ..... *E21B 17/1078* (2013.01); *E21B 17/08* (2013.01); *E21B 17/1014* (2013.01); *E21B 23/04* (2013.01)

(58) Field of Classification Search
CPC ..... E21B 23/01; E21B 23/04; E21B 17/08; E21B 17/1078; E21B 17/1014
USPC ..... 166/212, 241.1, 242.7, 380; 175/325.1, 175/81
See application file for complete search history.

(56) References Cited

U.S. PATENT DOCUMENTS

| | | | | | |
|---|---|---|---|---|---|
| 2,874,783 | A | * | 2/1959 | Haines | 166/212 |
| 2,982,355 | A | * | 5/1961 | Rodgers | 166/68.5 |
| 3,126,971 | A | * | 3/1964 | Kellner et al. | 175/230 |
| 3,347,317 | A | * | 10/1967 | Zandmer | 166/100 |
| 3,395,758 | A | | 8/1968 | Kelly et al. | |
| 3,425,491 | A | * | 2/1969 | Zandmer | 166/205 |
| 4,589,484 | A | * | 5/1986 | Doherty et al. | 166/179 |
| 5,228,518 | A | | 7/1993 | Wilson et al. | |
| 5,423,382 | A | * | 6/1995 | Barton et al. | 166/297 |

(Continued)

FOREIGN PATENT DOCUMENTS

EP 0978630 A2 2/2000

OTHER PUBLICATIONS

International Preliminary Report on Patentability, issued in PCT/NO2012/050176 on Mar. 18, 2014.

(Continued)

*Primary Examiner* — Daniel P Stephenson
(74) *Attorney, Agent, or Firm* — Sack IP Law, P.C.; Alan M. Sack

(57) ABSTRACT

There is disclosed a tool for centering a casing or liner In a borehole. The tool Includes a tubular section Inserted In the casing/liner. A number of pressure cylinders (4) are mounted in the tubular section along the circumference. The pressure cylinders may be expanded by pressure from the Inside of the tubular section. In use, the casing/liner with the tubular section is run into the borehole with the pressure cylinders retracted. Thereafter, the pressure Inside the casing/liner Is Increased pressing the pressure cylinders out and centering the casing/liner.

11 Claims, 3 Drawing Sheets

(56) References Cited

U.S. PATENT DOCUMENTS

| | | | | |
|---|---|---|---|---|
| 7,204,325 | B2 * | 4/2007 | Song et al. | 175/61 |
| 7,866,383 | B2 * | 1/2011 | Dusterhoft et al. | 166/227 |
| 8,079,416 | B2 * | 12/2011 | Parker | 166/285 |
| 8,104,538 | B2 * | 1/2012 | Richard et al. | 166/308.1 |
| 8,127,858 | B2 * | 3/2012 | Lynde et al. | 166/383 |
| 8,365,827 | B2 * | 2/2013 | O'Connell et al. | 166/308.1 |
| 8,646,523 | B2 * | 2/2014 | Huang et al. | 166/100 |
| 2004/0011525 | A1 | 1/2004 | Jones et al. | |
| 2004/0079535 | A1 | 4/2004 | Richard et al. | |
| 2005/0205305 | A1 * | 9/2005 | Stout et al. | 175/292 |
| 2005/0284633 | A1 * | 12/2005 | Richard | 166/278 |
| 2006/0042801 | A1 * | 3/2006 | Hackworth et al. | 166/387 |
| 2007/0272411 | A1 * | 11/2007 | Lopez De Cardenas et al. | 166/305.1 |
| 2008/0035349 | A1 * | 2/2008 | Richard | 166/308.1 |

OTHER PUBLICATIONS

Written Opinion of the International Searching Authority, issued in PCT/NO2012/050176, Dec. 14, 2012.

* cited by examiner

TOOL FOR CENTERING A CASING OR LINER IN A BOREHOLE AND METHOD OF USE

FIELD OF THE INVENTION

The present invention relates to a tool for use in the oil industry, and in particular a tool for use when cementing/zone isolating casings or liners in wells for the production of oil and/or gas, or for injection.

TECHNICAL BACKGROUND

A well is drilled in several sections (due to formation changes/pressure) of different sizes. There are many types and sizes of casing/liners with associated bits and hole openers. Commonly used casing/liners sizes are: 30", 20", 18⅝", 16", 13⅜", 11¾", 10¾", 9⅝", 8⅝", 7¾", 7⅝", 7", 6⅝", 5½", 5" and 4½".

Bit sizes go from 30", 26", 24", 22", 20", 17½", 16", 14¾", 13½", 12¼", 11", 10¾", 9⅞", 9½", 8¾", 8⅜", 8⅜", 7⅞", 6¾", 6½", 6¼", 6⅛", 6", 5⅞", 4¼", 3⅞" and 3¾". Different sizes of hole openers in addition to bits are used depending on the formation, they go from 36" and down to about 7".

A typical well drilled on the Norwegian continental shelf can be as follows: One starts by drilling a 36" hole using 30" bit and a 36" hole opener in order to insert a 30" conductor/casing (it can also be rammed into the seabed using a special hammer from the rig).

A 24" hole is then drilled for 18⅝" casing/well head assembly (anchoring tube for the next casings).

A 17½" hole is then drilled for setting a 13⅜" casing.

A 12½" hole is then drilled for 9⅝" casing.

An 8½" hole is then drilled for 7" casing.

All casings as mentioned above are cemented either to anchor itself or for making isolation between different zones, or both, but in particular for the 18⅝", 13⅜" and 9⅝" casings it is important to have good zone isolation. The lower part of these sections tends to have a high angle, the angle being more horizontal than vertical.

When a hole is drilled with e.g. a 12½" bit, the hole normally ranges from 12½" to maybe in some places up to as much as 14"-15".

In some cases, the hole will creep after the well has been drilled, i.e. when the hole has been drilled, the drill string must be pulled out of the hole and the casing must run into the hole. This may take up to 1-2 days. The hole can then be significantly smaller in dimension than as originally drilled, sometimes so narrow that it is not possible to run in with the casing to the bottom. The whole length of casing must then be pulled out of the hole (if possible) and go down with the bit again on the drill string to open the hole to the original size and try to run the casing again. Occasionally the casing must be set where it stops due to being stuck, and this section will then be "lost" because it is not fully set, e.g. on top of the reservoir.

When the casing is run into the hole, there will normally be a centralizer on each collar on the lowermost 200 meters (this is a requirement in Norway). Centralizers are designed to center the casing so that, when pumping the cement, the cement will enter inside the casing and exit at the bottom of the casing and up on the outside of the casing, the cement is intended to displace the well fluid between the formation and the casing and fill the volume between the formation and the casing all around the area where there are centralizers, to get a good zone isolation.

One of the biggest challenges of drilling a borehole and completing it in accordance with applicable requirements is precisely zone isolation (the cementing of casings). The challenge is that it is difficult to achieve a good cementing job, cementing jobs are usually of varying quality due to channeling of the cement and/or the lower side of the casing resting against the formation due to gravity.

The consequence of not having a good cementing/isolation job around the casing is that you can get migration of oil/gas reservoir to shallower formations or even all the way to the sea bed and surface.

If the oil/gas reservoir migrates to shallower formations, the pressure from the reservoir at the original depth will be moved to the shallower formation. In some cases this will make it is impossible to drill into the shallower formations because the pressure is too high for the drilling mud to be able to compensate for the abnormally high pressure formed due to the migration.

Only 20% of the cement jobs are satisfactory. The remaining 80% are too poor to be characterized as good zone isolation.

This is one of the reasons that there are leaks between the different zones and in some instances the reservoir migrates into overlying zones and it may lead to being difficult or almost impossible to handle as the pressure becomes too high in the "new" reservoir to balance the formation pressure by work over or new wells (ref. Gullfaks).

Centralizers on the market today are either positive, i.e. they are run into the hole with tensioned steel spring slats centering the casing all the way from the top side to the setting point (bottom of hole), or there are fixed (solid) centralizing tools available, but here the challenge is that they form a resistance/hindrance for the cement to be pumped up the annulus without meeting too much resistance.

Both methods are known to be a resistance/hindrance preventing the casing from entering fully down due to resistance and tearing of the hole wall.

Sometimes it is not possible to run casing as far as planned, then the casing must be pulled again to adjust the length of the casing or the casing must be removed in its entirety and then a new hole section must be drilled before we can run and set the casing again. It is thus a challenge that the centralizing tools may be torn apart and in the worst case cause major problems for completing the well.

Regarding the centralizers on the market today, they are driven into the hole activated, i.e. they are designed to center the casing from the very start to run casing from the rig until they are right on setting depth. They will then tear up the formation and exercise resistance all along the well path length, they will also make "dunes" of formation ahead which will exert great friction when circulating drilling mud before pumping cement.

SUMMARY OF THE INVENTION

It is an object of the present invention to provide a tool for centering casing which avoids or at least minimizes the above-mentioned disadvantages with known tools. The tool is adapted to be inserted into the well in a non-activated state and will therefore be less aggressive to the borehole wall. Furthermore, the tool is designed for use in deviated wells.

BRIEF DESCRIPTION OF THE DRAWINGS

The invention will now be described in detail with reference to the accompanying drawings, wherein.

DETAILED DESCRIPTION

Figure 1A:
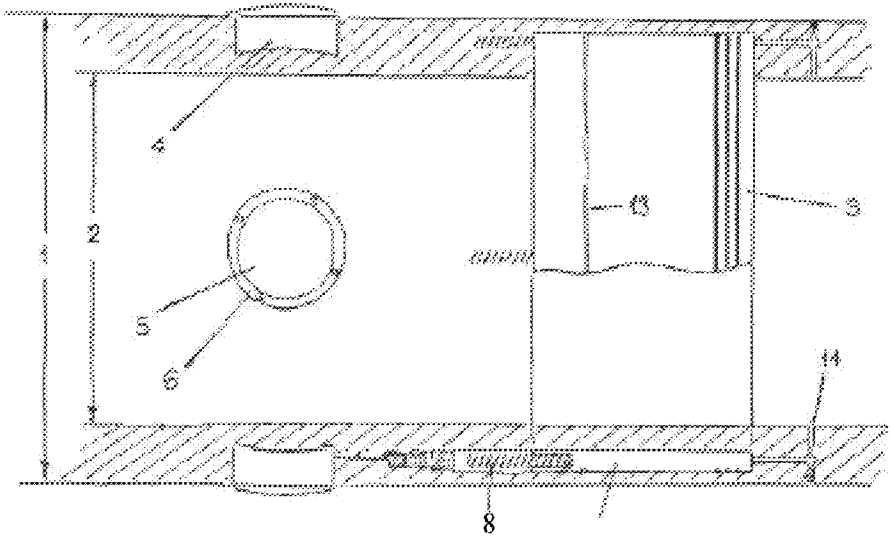
FIG. 1A is a longitudinal section through a first embodiment of the inventive tool.
Figure 1B:
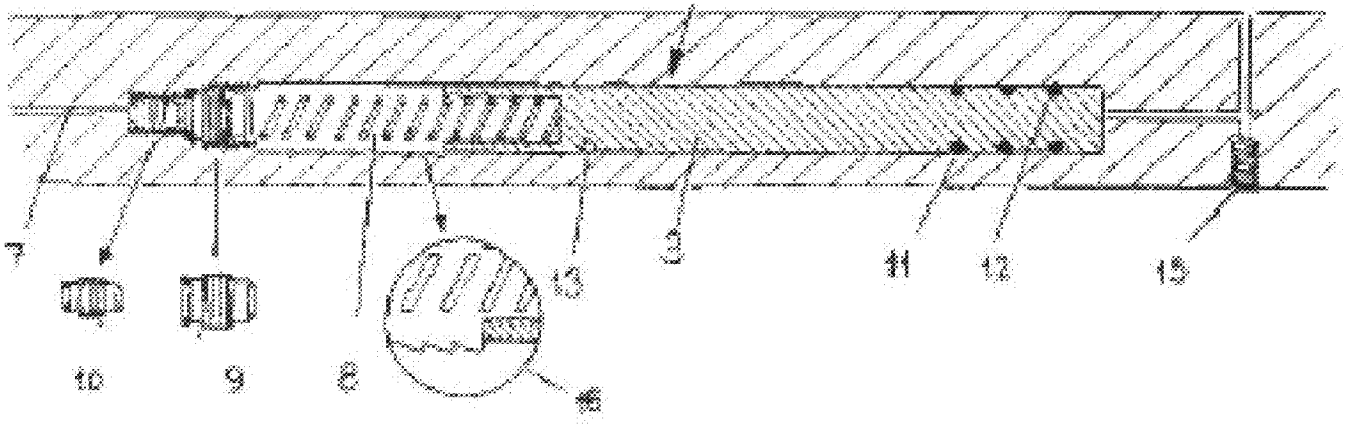
FIG. 1B shows a detail of the same.

FIG. 1A shows a first embodiment of the tool in section. The tool comprises a tubular section, such as a casing collar, where a number of pressure cylinders 4 are inserted peripherally. The tool is lowered into the borehole with the pressure cylinders 4 recessed. When the tool is put in place the pressure cylinders 4 are expanded so that they each press a clamping plate or shoe 5 against the borehole wall. In a deviation well the casing will lie against the borehole wall on the lower side. When the cylinders are expanded the casing will be lifted off from the borehole wall on the lower side and be centered in the borehole. In the following cementation process cement will also gain access to the lower side of the pipe and thereby ensure full embedding.

The pressure cylinders 4 are maneuvered by means of pressure from inside the casing. The pressure inside the casing is passed to a ring piston 3 which is located in an annular cylinder in the wall of the casing, see FIGS. 1A and B. The pressure is conducted to one side of the ring piston through the intake channels 14 which open into the inside of the casing. On the other side of the ring piston 3 there are one or more springs 8 which bias the piston toward an upper initial position when there is no pressure inside the casing. From below the piston pressure channels 7 go to each pressure cylinder 4. Check valves 9 are installed in the pressure channels 7. The room on the lower side of the ring piston 3 contains hydraulic oil. In the wall of the ring piston 3 is a locking groove 13 that runs around the circumference of the piston. The locking groove is adapted to cooperate with hooks 16 in the wall on the ring cylinder on the lower side of the ring piston when it is in its initial position.

To activate the tool, internal pressure inside the casing must increase. Ring piston 3 is then pushed downwards to press oil into the pressure cylinders 4 so that they are expanded. When the ring piston is forced downwards the hooks 16 will enter the locking groove 13. This ensures that the ring piston does not return when the pressure inside the casing is subsequently lowered again. The same function is also covered by the check valves 9. The invention can thus be realized with either check valves or hooks and locking grooves, or both.

Figure 2B:
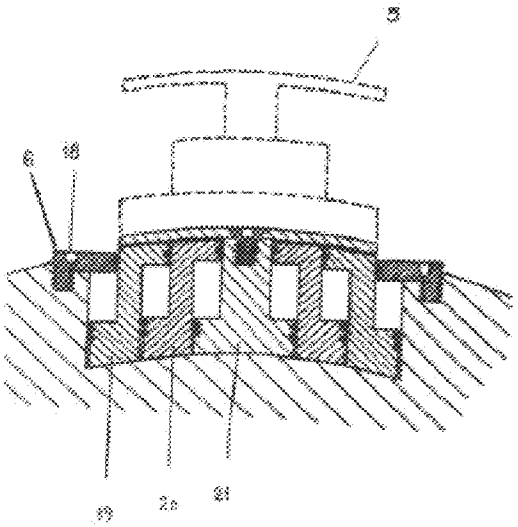
FIG. 2B shows a detail of the same.
Figure 2A:
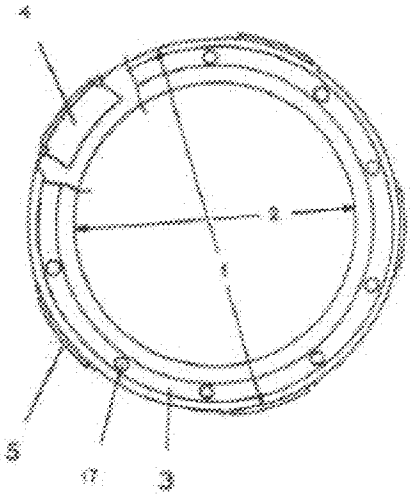
FIG. 2A is a cross section through the tool.

FIG. 2A shows the tool in cross-section. The pressure cylinders 4 are embedded in the wall of the pipe section below the ring piston 3 which runs in a ring cylinder inside the wall of the pipe section.

FIG. 2B is a section through a pressure cylinder 4 with pressure plate 5. The pressure cylinder is shown in a contracted state (solid lines) and in the extended state (dashed lines). The pressure cylinder 4 is telescopic and includes three pistons 19, 20 and 21. The outer piston 19 is annular and runs in a bore of the pipe section wall. The middle piston 20 is likewise annular and runs inside the outer piston 19. The inner piston 21 runs within the middle piston and carries the pressure plate 5. A fixing ring 6 secures the pressure cylinder 4 in the bore.

Figure 3A:
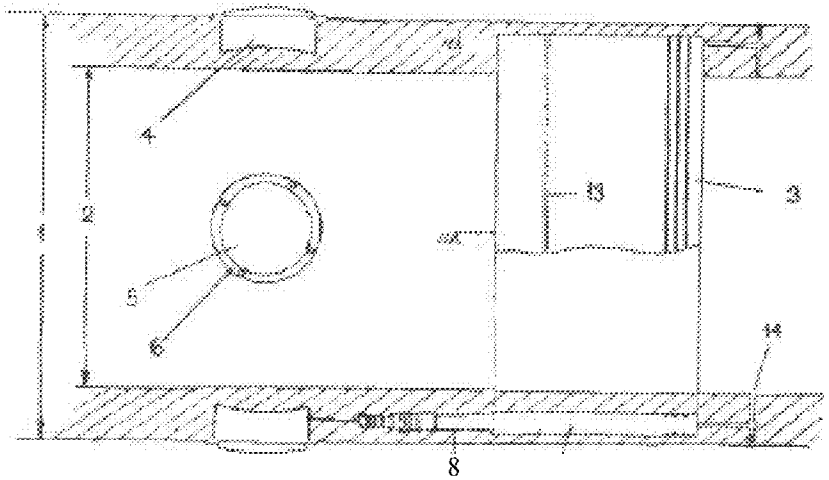
FIG. 3A is a longitudinal section through a second embodiment of the inventive tool.
Figure 3B:
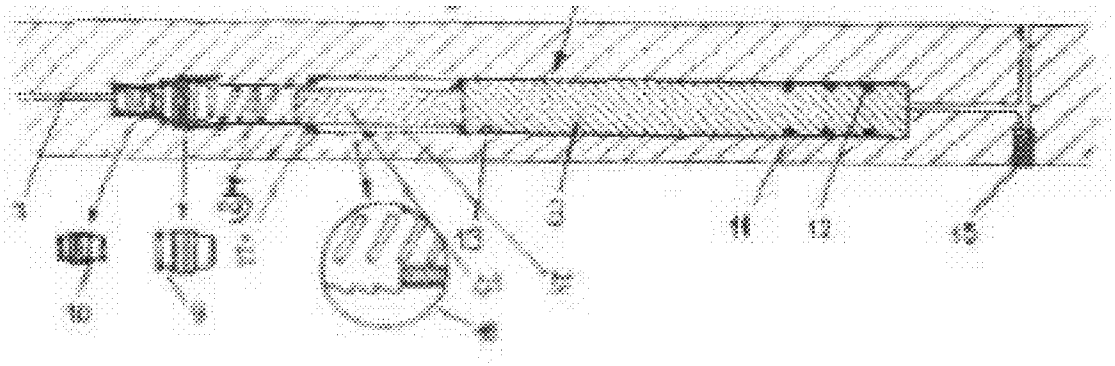
FIG. 3B shows a detail of the same.

FIG. 3A shows a second embodiment of the invention. Here, a number of small transfer pistons 23 are inserted in separate transfer cylinders 24 between the lower side of the ring piston 3 and each pressure cylinder 4, i.e. in each pressure channel 7. There are separate springs 8 below each small transfer piston 23. The object of the small transfer pistons is to isolate each pressure cylinder 4 from each other preventing the pressure from the ring piston 3 from acting on only one or a few of the pressure cylinders and instead forcing all the pressure cylinders to move synchronously. The area below the ring piston 3 may be filled with air or another gas which is easily compressible when the piston is lowered. In case this area is filled with a liquid which is not so easily compressible, one or more openings may be provided to the outside of the tubular section which bleed off the pressure when the piston is lowered (not shown).

The tool has the following advantages:

The centralizing tool is integrated in the casing collar.

In addition to the casing joints connecting the tubes they will also act as centralizing tools for casing.

The centralizing tool is run in the hole in an inactivated position. That means that they do not pose any additional resistance scratching and/or digging into the formation along the hole track.

Once the casing is run into the hole and located in the correct position, the centralizing tool is activated causing the casing to be lifted up from the bottom of the horizontal wellbore and centered in the borehole, there will then be a clearance between the hole wall and the casing throughout the length where a centering tool is mounted.

The centralizing tool is actuated by pressure from the inside of the casing, for example, pressurizing the casing to about 50 bar. It is milled out a number of channels, such as five, from the inside of the casing and into the ring cylinder on top of the ring piston. (The ring cylinder is machined into the casing collar.) Pressure from casing pressing against the ring piston and the small pistons causes them to be pressed down pressing hydraulic oil present in the chamber below the piston against, for example 10-20 casing collars with telescopic cylinders which are positioned in the connector facing outwards, these will be pushed out approximately 3-4 cm or more, and will hit the borehole wall thereby lifting and centering the casing in the center of the borehole.

Between the ring cylinder with the small pistons and the oil chamber is drilled a channel such as 4 mm. In this channel is mounted a one-way valve in each channel (here a total of 5 pieces) so that it is not possible to get any back pressure at the ring cylinder. In each chamber (here a total of 5) there are fitted two to three telescopic cylinders pointing 90 degrees from the casing wall, these will be forced out around 3-4 cm, and will hit the borehole wall and thus push and center the casing in the hole wall.

There will be several telescopic cylinders; here five pairs, equally distributed around the circumference of the casing collar.

A PSV (safety valve) is also inserted in each channel so that if the telescopic cylinders are located in a narrow borehole field preventing them from being completely expanded before the pressure increases, the PSV will bleed off pressure of in excess of 70-80 bar and then close again. Whatever hole size (resistance) the ring piston with its small pistons will bottom out in the ring cylinder and hit a mechanical seal.

REFERENCE NUMERALS USED IN THE FIGURES

1 Outside diameter. In addition, there may be some millimeters outside of the clamping plates depending on the design.

2 Inner diameter.
3 Ring piston.
4 Pressure cylinder.
5 Clamping plate.
6 Locking ring for pressure cylinder.
7 Pressure channel from the lower side of the ring piston to the pressure cylinder.
8 Spring holding the piston in its initial position.
9 Check valve.
10 Nozzle. This is in order to obtain an approximately equal walk on all cylinders.
11 O-rings, outside the ring piston.
12 O-rings, inside the ring piston.
13 Locking ring to prevent ring piston from returning after the operation. Helps to keep the pressure cylinders activated.
14 Intake channel of pressure fluid. Many channels of small diameter help to prevent the channel to the ring piston from becoming clogged from "unclean" pressure fluid.
15 Plug. This fills holes that are eventually required to be drilled.
16 Ratchet slot for the locking ring.
17 Holes in the end of the ring piston for placement of the required number of springs, cf. reference numeral 8.
18 Trackholes for screwing pressure cylinders.
19 Piston No. 1 in telescopic pressure cylinder.
20 Piston No. 2
21 Piston No. 3
22 Metal seal, between the ring piston and the ring cylinder.
23 Transfer piston (small), to each of the channels to the pressure cylinders.
24 Ring cylinder.
25 Cylinder for the transfer piston, one for each of the channels leading to the pressure cylinders.

The invention claimed is:

1. A tool for centralizing a casing or liner in a borehole, comprising:

a tubular section to be inserted between two sections of the casing or liner, a plurality of pressure cylinders mounted in bores along the circumference of the tubular section, wherein the pressure cylinders are adapted to expand radially by means of a pressure exerted on the inside of the tubular section, a ring piston running in a ring cylinder in the wall of the tubular section, a number of intake channels leading from the inside of the tubular section to a first side of the ring piston, a number of pressure channels leading from a second side of the ring piston to each pressure cylinder, and mechanism for preventing the ring piston from going from an activated position in which the pressure cylinders are expanded back to an in-activated position selected from the group consisting of:

locking grooves in the ring piston co-operating with locking hooks arranged in the wall of the ring cylinder, and check valves arranged in the pressure channels.

2. The tool according to claim 1, further comprising one transfer piston running in transfer cylinders for each pressure cylinder, wherein the transfer pistons and transfer cylinders are arranged between the ring cylinder, on the second side of the ring piston, and each pressure channel.

3. The tool according to claim 2, wherein a spring is arranged below each transfer piston.

4. The tool according to claim 1, wherein at least one spring is arranged on the second side of the ring piston.

5. The tool according to claim 1, wherein said mechanism for preventing the ring piston from going from an activated position to an in-activated position are locking grooves in the ring piston co-operating with locking hooks arranged in the wall of the ring cylinder.

6. The tool according to claim 1, further comprising safety valves arranged in each pressure channel.

7. The tool according to claim 1, wherein each pressure cylinder is telescopic.

8. The tool according to claim 1, wherein said mechanism for preventing the ring piston from going from an activated position to an in-activated position are check valves arranged in the pressure channels.

9. The tool according to claim 1, wherein said mechanism for preventing the ring piston from going from an activated position to an in-activated position are locking grooves in the ring piston co-operating with locking hooks arranged in the wall of the ring cylinder and check valves arranged in the pressure channels.

10. A method for centralizing a casing or liner in a borehole, comprising:

(a) installing a tubular section between two sections of the casing or liner, (b) running the casing or liner with the tubular section into the borehole, (c) applying a pressure on the inside of the casing or liner, (d) transferring the pressure to a plurality of pressure cylinders arranged in bores along the circumference of the tubular section, and (e) expanding the pressure cylinders radially centralizing the casing or liner, wherein the pressure transfer step (d) comprises first applying pressure on the inside of the casing or liner to a first side of a ring piston running in a ring cylinder in the wall of the tubular section, followed by applying pressure to the pressure cylinders from a second side of the ring piston.

11. The method according to claim 10, wherein the step of applying pressure to the pressure cylinders from a second side of the ring piston in pressure transfer step (d) further comprises first applying pressure on a first side of a plurality of transfer pistons, each running in a transfer cylinder arranged between the ring cylinder on the second side of the ring piston, and each pressure channel, followed by applying pressure to said pressure cylinders from a second side of the transfer pistons.

* * * * *